US006846068B2

(12) United States Patent
Kim

(10) Patent No.: US 6,846,068 B2
(45) Date of Patent: Jan. 25, 2005

(54) MONOLITHIC INK-JET PRINTHEAD AND METHOD FOR MANUFACTURING THE SAME

(75) Inventor: Yun-gi Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 12 days.

(21) Appl. No.: 10/414,301

(22) Filed: Apr. 16, 2003

(65) Prior Publication Data

US 2004/0027424 A1 Feb. 12, 2004

(30) Foreign Application Priority Data

Aug. 9, 2002 (KR) ..... 10-2002-0047211

(51) Int. Cl.[7] ..... B41J 2/05
(52) U.S. Cl. ..... 347/64
(58) Field of Search ..... 347/64, 63, 56, 347/61, 20, 68–72, 62, 54, 50, 44, 47, 27; 349/261; 361/700; 310/328–330; 29/890.1; 438/21, 38

(56) References Cited

U.S. PATENT DOCUMENTS

| | | | | |
|---|---|---|---|---|
| 4,882,595 A | | 11/1989 | Trueba et al. | |
| 5,912,685 A | | 6/1999 | Raman | |
| 6,387,719 B1 | * | 5/2002 | Mrvos et al. | 438/21 |
| 6,550,893 B2 | * | 4/2003 | Mrvos et al. | 347/44 |

* cited by examiner

*Primary Examiner*—Raquel Yvette Gordon
(74) *Attorney, Agent, or Firm*—Staas & Halsey LLP

(57) ABSTRACT

An ink-jet printhead and a method of manufacturing the same include utilizing a substrate on which at least one heater and a passivation layer protecting the at least one heater are formed, a passage plate which forms an ink chamber corresponding to the at least one heater, and a nozzle plate in which an orifice corresponding to the ink chamber is formed. The passage plate and the nozzle plate are formed of photoresist, and an adhesion layer formed of silicon-family low-temperature deposition material at a temperature limited by the characteristics of the passage plate is disposed between the passage plate and the nozzle plate.

37 Claims, 6 Drawing Sheets

MONOLITHIC INK-JET PRINTHEAD AND METHOD FOR MANUFACTURING THE SAME

CROSS-REFERENCE TO RELATED APPLICATIONS

This application claims the priority of Korean Patent Application No. 2002-47211, filed on Aug. 9, 2002, in the Korean Intellectual Property Office, the disclosure of which is incorporated herein in its entirety by reference.

BACKGROUND OF THE INVENTION

1. Field of the Invention

The present invention relates to a monolithic ink-jet printhead and a method of manufacturing the same, and more particularly, to a monolithic ink-jet printhead including a nozzle plate having a good hydrophobic property and an effective adhering property, and a method of manufacturing the same.

2. Description of the Related Art

In general, ink-jet printheads may eject ink droplets using an electro-thermal transducer (ink-jet type), which generates bubbles in ink by means of a heat source.

FIG. 1 is a schematic perspective view illustrating the structure of a conventional ink-jet printhead, and FIG. 2 is a schematic cross-sectional view of the ink-jet printhead shown in FIG. 1. Referring to FIGS. 1 and 2, an ink-jet printhead includes a manifold (not shown) to which ink is supplied, a substrate 1 on which a heater 12 and a passivation layer 11 protecting the heater 12 are formed, a passage plate 2 which forms an ink passage 22 and an ink chamber 21 on the substrate 1, and a nozzle plate 3 which is formed on the passage plate 2 and has an orifice 31 corresponding to the ink chamber 21.

In general, a passage plate and a nozzle plate are formed by a photolithography process using polyimide. In a conventional ink-jet printhead, the passage plate and the nozzle plate are formed of the same material, for example, polyimide. The nozzle plate may be easily detached from the passage plate due to a weak adhering property of polyimide.

In order to solve this problem, in a conventional method to manufacture an ink-jet printhead, when a passage plate and a nozzle plate are formed of polyimide as separate layers as described above, the passage plate and the nozzle plate are separately formed and are bonded with a substrate. In this method, due to several problems, including structural misalignment, the nozzle plate cannot be attached to a substrate such as a wafer, and the nozzle plate should be attached to each chip separated from the wafer. Thus, this method results in low productivity.

Meanwhile, in conventional methods of manufacturing an ink-jet printhead, a mold layer is used as a sacrificial layer to form an ink chamber and an ink passage.

In the conventional methods, a sacrificial layer is formed of a photoresist on a substrate to correspond to patterns of an ink chamber and an ink passage, polyimide is coated to a predetermined thickness on the sacrificial layer, and a passage plate and a nozzle plate are formed as a single body. Then, an orifice (nozzle) is formed in the nozzle plate, and the sacrificial layer is finally removed such that the ink chamber and the ink passage are formed below the nozzle plate. In the conventional methods of forming an ink passage and a nozzle using a mold layer, the passage plate and the nozzle plate are formed of polyimide to protect the mold layer. However, the plates and the mold layer cannot be hard-baked at a sufficient temperature, since the mold layer is formed of a photoresist having a low heat-resistant property. Due to the presence of the mold layer, the passage plate or nozzle plate formed of polyimide cannot be hard-baked. In addition, the non-hard-baked passage plate or nozzle plate is damaged by an etchant when the mold layer used to form the ink passage and the ink chamber is removed. In particular, a portion where the passage plate contacts the nozzle plate is etched, and an interface between the passage plate and the nozzle plate damaged by the etchant becomes unstable, and thus becomes loose.

The nozzle plate of an ink-jet printhead is directly opposite to the recording paper and has several factors that affect the ejection of ink droplets ejected through a nozzle. Among these factors, when a hydrophobic property on the surface of the nozzle plate is low, that is, when the surface of the nozzle plate has a hydrophilic property, part of the ink ejected through the nozzle flows out of the surface of the nozzle plate, contaminates the surface of the nozzle plate, and the size, direction, and speed of the ejected ink droplets become nonuniform. As described above, the nozzle plate formed of polyimide has a hydrophilic property, and thus has the above-mentioned problems. In order to solve the problems caused by a hydrophilic property, in general, a coating layer for a hydrophobic property should be additionally formed on the surface of the nozzle plate formed of polyimide. Metals, such as plated nickel (Ni), gold (Au), palladium (Pd), or tantalum (Ta), and a perfluoronated alkane and silane compound having a high hydrophobic property, such as fluoronated carbon (FC), F-Silane, or diamond like carbon (DLC), are used as the coating layer. The hydrophobic coating layer may be formed by wet etching, namely, spray coating or spin coating, and may be deposited by dry etching, namely, plasma enhanced chemical vapor deposition (PECVD) and sputtering. Using the coating layer that has a hydrophobic property causes an increase in costs for an ink-jet printhead.

SUMMARY OF THE INVENTION

The present invention provides a monolithic ink-jet printhead including a nozzle plate having an effective hydrophobic property and an improved adhering property to a passage plate.

Additional aspects and advantages of the invention will be set forth in part in the description which follows and, in part, will be obvious from the description, or may be learned by practice of the invention.

The present invention further provides a method to manufacture a monolithic ink-jet printhead in which a nozzle plate and a passage plate are formed at a wafer level.

According to one aspect of the present invention, an ink-jet printhead includes a substrate on which at least one heater and a passivation layer protecting the at least one heater are formed, a passage plate which forms an ink chamber corresponding to the at least one heater, and a nozzle plate in which an orifice corresponding to the ink chamber is formed. The passage plate and the nozzle plate are formed of photoresist, and an adhesion layer formed of silicon-family low-temperature deposition material at a temperature limited by the characteristics of said passage plate is disposed between the passage plate and the nozzle plate.

Preferably, the passage plate and the nozzle plate are formed of polyimide. It is also preferable that the adhesion layer is formed of a material selected from a group of $SiO_2$, SiN, and SiON, and the adhesion layer is formed through plasma enhanced chemical vapor deposition (PECVD).

According to an aspect of the present invention, the printhead further includes a coating layer formed of silicon-family low-temperature deposition compound on the surface of the nozzle plate. The coating layer is formed of material selected from a group of $SiO_2$, SiN, and SiON. Preferably, the coating layer extends to the bottom of the ink chamber.

According to another aspect of the present invention, a method to manufacture an ink-jet printhead comprises preparing a substrate on which a heater and a passivation layer protecting the heater are disposed, forming a passage plate, in which an ink chamber corresponding to the heater and an ink passage connected to the ink chamber are formed, of a first photoresist on the substrate, forming an adhering layer of a low-temperature silicon-family material on the surface of the passage plate, filling the ink chamber and the ink passage with a second photoresist, forming a nozzle plate of a third photoresist on the passage plate, forming an orifice corresponding to the ink chamber in the nozzle place, and removing the second photoresist in the ink chamber using a wet etch technique.

The first photoresist and the third photoresist are polyimide. The adhering layer is formed of a material selected from a group of $SiO_2$, SiN, and SiON, and preferably, is formed through plasma enhanced chemical vapor deposition (PECVD).

Filling the ink chamber generally comprises coating the entire surface of the second photoresist, and etching back to leave a photoresist only in the ink chamber.

Between the operations of forming an orifice and removing the second photoresist, the second photoresist existing in the ink chamber is ashed by high temperature heating, and a material remaining in the second photoresist is stripped using a wet etchant.

According to an aspect of the present invention, after the operation of removing the second photoresist in the ink chamber, the method further comprises forming a coating layer of a low-temperature deposition silicon-family material on the nozzle plate. The coating layer is formed of a material selected from a group of $SiO_2$, SiN, and SiON.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
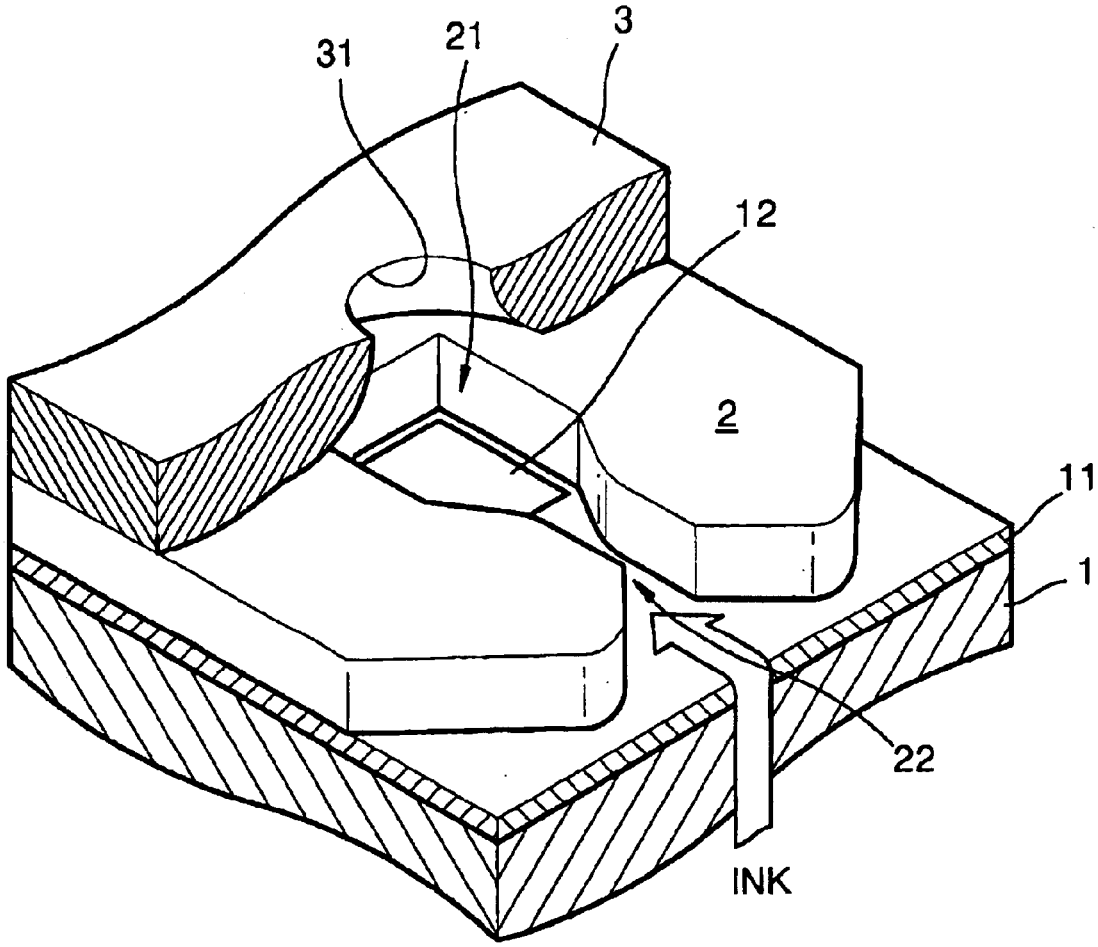
FIG. 1 (PRIOR ART)
FIG. 1 is a schematic perspective view illustrating the structure of a conventional ink-jet printhead.
Figure 2:
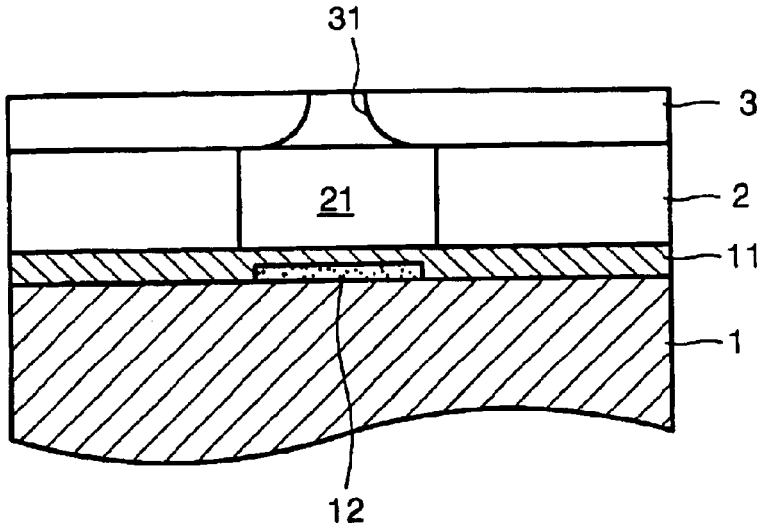
FIG. 2 (PRIOR ART)
FIG. 2 is a schematic cross-sectional view of the conventional ink-jet printhead shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, preferred embodiments of an ink-jet printhead and a method of manufacturing the same according to the present invention will be described in detail with reference to the accompanying drawings.

Figure 3:
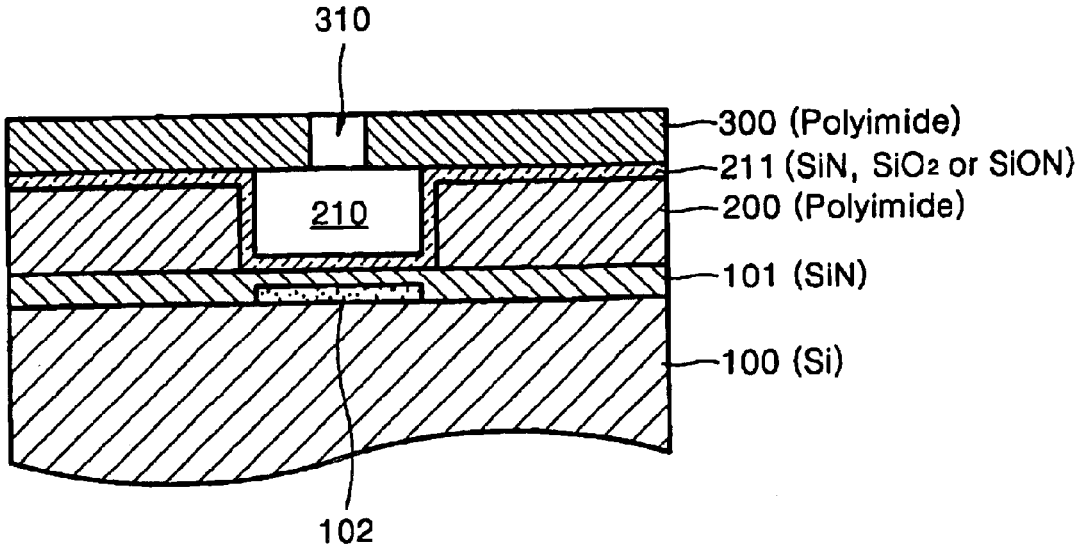
FIG. 3 is a schematic cross-sectional view illustrating a first embodiment of an ink-jet printhead according to the present invention.

FIG. 3 is a schematic plane view illustrating an embodiment of an ink-jet printhead according to the present invention.

As shown in FIG. 3, a heater 102 is formed over the surface of an Si substrate 100, and a passivation layer 101 is formed over the heater 102. The heater 102 is an electrical heating device and is connected to conductors and pads formed on the substrate 100. In the present embodiment and the following embodiments, the conductors and pads are not shown. A passage plate 200 formed of a photoresist such as polyimide, is placed on the passivation layer 101. The passage plate 200 provides an ink chamber 210 placed above the heater 102 and an ink supply route (not shown) for supplying ink to the ink chamber 210. An adhering layer 211 formed of a photoresist such as polyimide and a silicon-family material such as $SiO_2$, SiN, or SiON having a high adhering property, is formed on the surface of the passage plate 200 and on the inner wall and bottom of the ink chamber 210. A nozzle plate 300 formed of a photoresist, preferably, formed of the same material as the passage plate 200, for example, polyimide, is placed on the adhering layer 211. Since the adhering layer 211 is formed of a photoresist such as polyimide and a silicon-family material having a high adhering property such as $SiO_2$, SiN, or SiON, adhering states of the passage plate 200 and the nozzle plate 300 are firmly maintained. Also, the adhering layer 211 is formed on the inner wall and bottom of the ink chamber 210 such that it protects the passage plate 200 and the nozzle plate 300 from ink. An orifice 310 through which ink droplets are ejected and which corresponds to the ink chamber 210, is formed in the nozzle plate 300.

As described above, the passage plate 200 and the nozzle plate 300 are formed of photoresists, preferably, polyimide. It is known that polyimide has low hydrophobic and adhering properties. However, the adhering layer 211 formed of a silicon-family material such as $SiO_2$, SiN, or SiON, is formed between the passage plate 200 and the nozzle plate 300 on the substrate 100. The silicon-family material has an effective adhering property, and thus, the passage plate 200 and the nozzle plate 300 can be firmly adhered to the substrate 100. A material used to form the adhering layer 211 is a material that can be deposited at a temperature, limited by the characteristics of the material used to form the passage plate 200, for example, in the case of polyimide, a material that can be deposited at a low temperature under 350° C. Thus, the passage plate 200 and the nozzle plate 300 can be formed at a wafer level.

Figure 4:
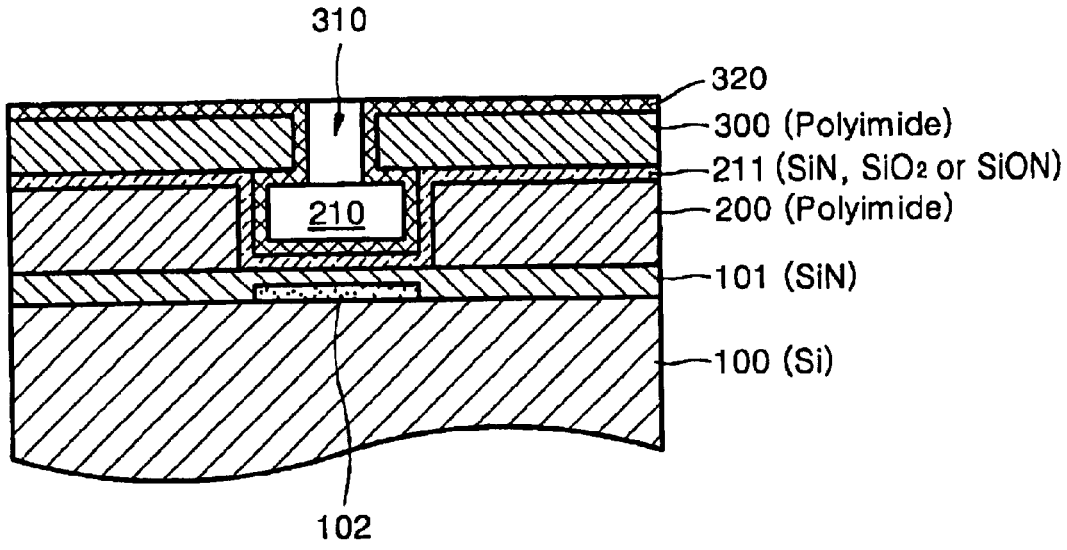
FIG. 4 is a schematic cross-sectional view illustrating a second embodiment of an ink-jet printhead according to the present invention.

FIG. 4 illustrates a second embodiment of an ink-jet printhead according to the present invention. As shown in FIG. 4, a heater 102 is formed on the surface of an Si substrate 100, and a passivation layer 101 is formed on the Si substrate 100. The heater 102 is an electrical heating device and is connected to conductors and pads formed on the substrate 100. In the present embodiment and the following embodiments, the conductors and pads are not shown. A passage plate 200 formed of a photoresist such as polyimide, is placed on the passivation layer 101. The passage plate 200 provides an ink chamber 210 placed above the heater 102 and an ink supply route (not shown) to supply ink to the ink chamber 210. An adhering layer 211 formed of a photoresist such as polyimide and a silicon-family material such as $SiO_2$, SiN, or SiON having a high adhering property, is formed on the surface of the passage plate 200 and on the inner wall and bottom of the ink chamber 210. A nozzle plate 300 formed of a photoresist, preferably, formed of the same material as the passage plate 200, for example, polyimide, is placed on the adhering layer 211. Since the adhering layer 211 is formed of a photoresist such as polyimide, and a silicon-family material having a high adhering property such as $SiO_2$, SiN, or SiON, adhering states of the passage plate 200 and the nozzle plate 300 are firmly maintained. Also, the adhering layer 211 is formed on the inner wall and bottom of the ink chamber 210 such that it protects the passage plate 200 and the nozzle plate 300 from ink. An orifice 310 through which ink droplets are ejected and which corresponds to the ink chamber 210, is formed in the nozzle plate 300. Meanwhile, a coating layer 320 is formed on the nozzle plate 300. The coating layer 320 may be formed of the same material as the adhering layer 211 and prevents the surface of the nozzle plate 300 from getting wet with ink. The coating layer 320 is formed on the nozzle plate 300 on an inner wall of the orifice 310 and on an inner wall and bottom of the ink chamber 210. The coating layer 320 can be coated through plasma enhanced chemical vapor deposition (PECVD).

Figure 5:
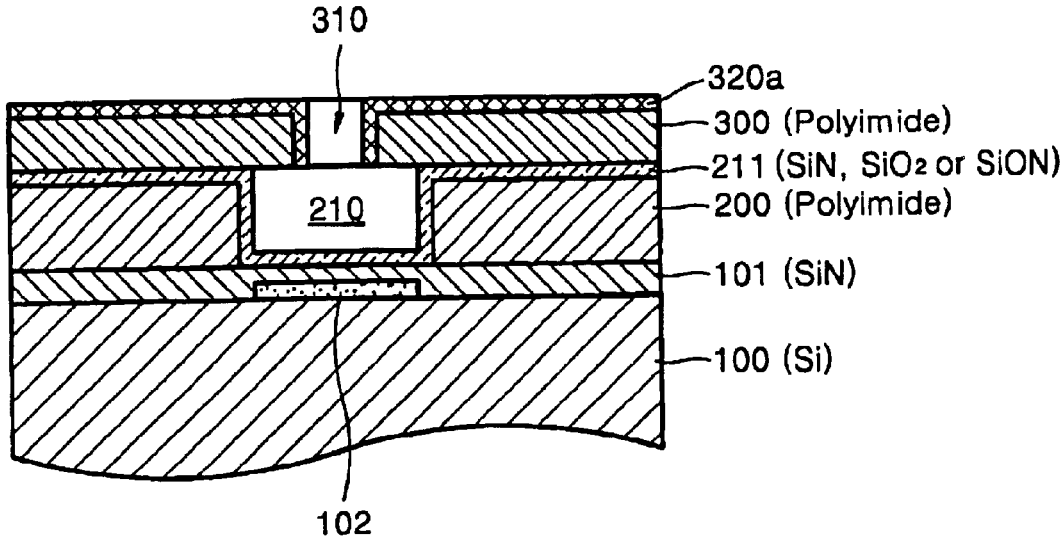
FIG. 5 is a schematic cross-sectional view illustrating a third embodiment of an ink-jet printhead according to the present invention.

FIG. 5 illustrates a third embodiment of an ink-jet printhead according to the present invention. In the third embodiment, unlike in the second embodiment, a coating layer 320*a* formed on the nozzle plate 300 is not formed in the ink chamber 210 because a material used to form the coating layer 320*a* is not permeated into the ink chamber 210. This shape can be formed by traditional physical deposition, for example, by sputtering.

Hereinafter, a method of manufacturing an ink-jet printhead according to the first and second embodiments of the present invention will be described in detail with reference to the accompanying drawings.

Well-known techniques such as forming a layer and patterning a layer, in particular, well-known techniques of manufacturing an ink-jet printhead will not be specifically described. FIGS. 6A through 6G are process views illustrating a method to manufacture an ink-jet printhead shown in FIG. 3, according to the present invention.

Figure 6A:
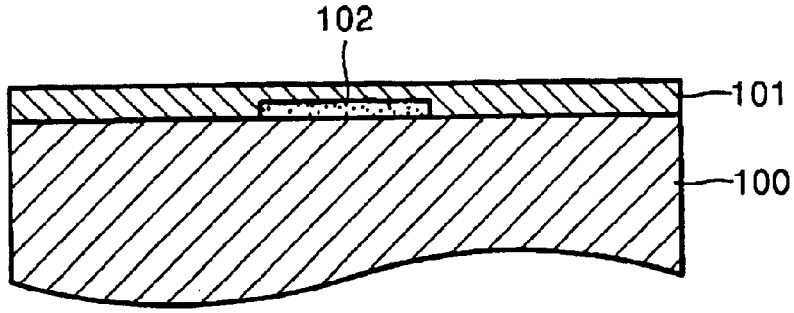
FIGS. 6A through 6G are process views illustrating a method to manufacture an ink-jet printhead shown in FIG. 3, according to an embodiment of the present invention.

As shown in FIG. 6A, a substrate 100 such as a silicon wafer, on which an underlayer, including a heater 102 and a SiN passivation layer 101 protecting the heater 102 is formed, is prepared. This operation is performed on a wafer and accompanies forming a material for use in a heater, patterning, and depositing a passivation layer.

Figure 6B:
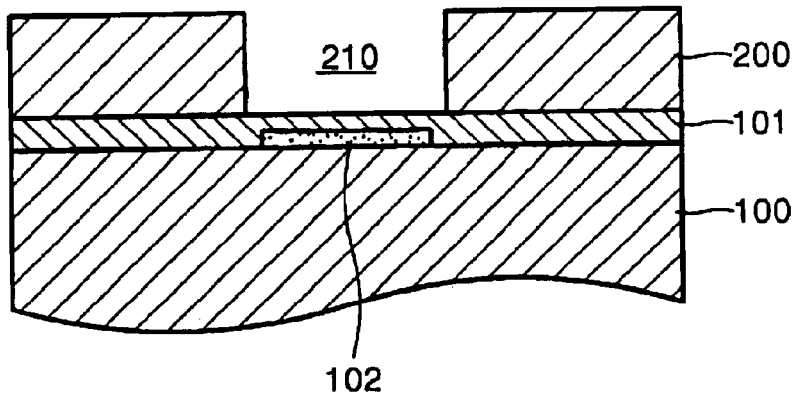

As shown in FIG. 6B, a photoresist, for example, polyimide, is coated to a thickness of several microns, for example, to a thickness of 30 microns, on the entire surface of the substrate 100 and is patterned by a photolithography process to form an ink chamber 210 and an ink passage (not shown) connected to the ink chamber 210. After a patterning operation, a passage plate 200 is formed of polyimide through a hard-baking operation.

Figure 6C:
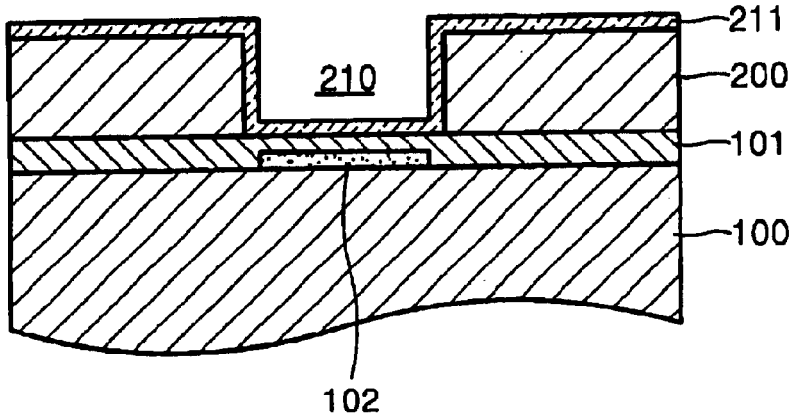

As shown in FIG. 6C, an adhering layer 211 is formed on the passage plate 200. In this case, the adhering layer 211 such as an $SiO_2$ layer, an SiN layer, or an SiON layer, is deposited through low temperature deposition under 400° C., for example, through PECVD, and thus, a nozzle plate 300 is formed. Thus, the adhering layer 211 is formed on the inner wall and bottom of the ink chamber 210.

Figure 6D:
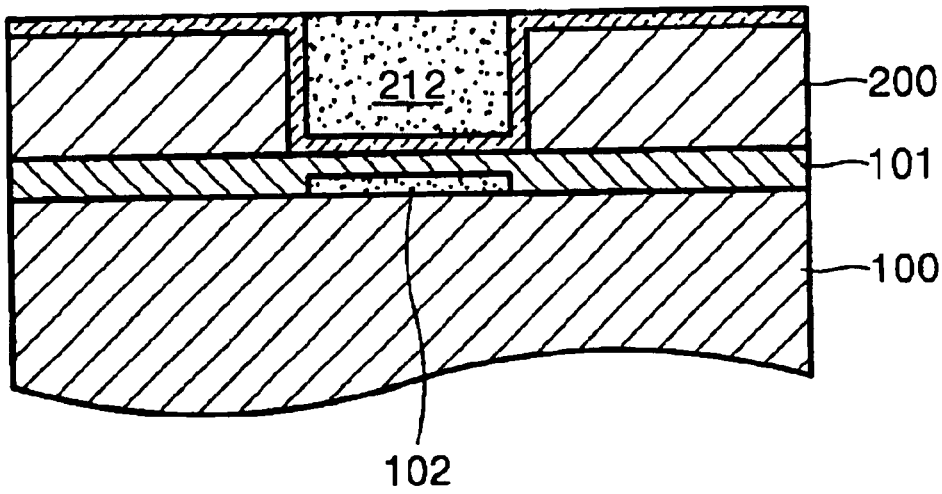

As shown in FIG. 6D, a mold layer 212 as a sacrificial layer is formed of a photoresist in the ink chamber 210. Here, after the photoresist is coated on the entire surface of the adhering layer 211 on the passage plate 200, an etchback process of leaving the photoresist only in the ink chamber 210 by flood etching or a photolithography process of partially exposing and etching may be used.

Figure 6E:
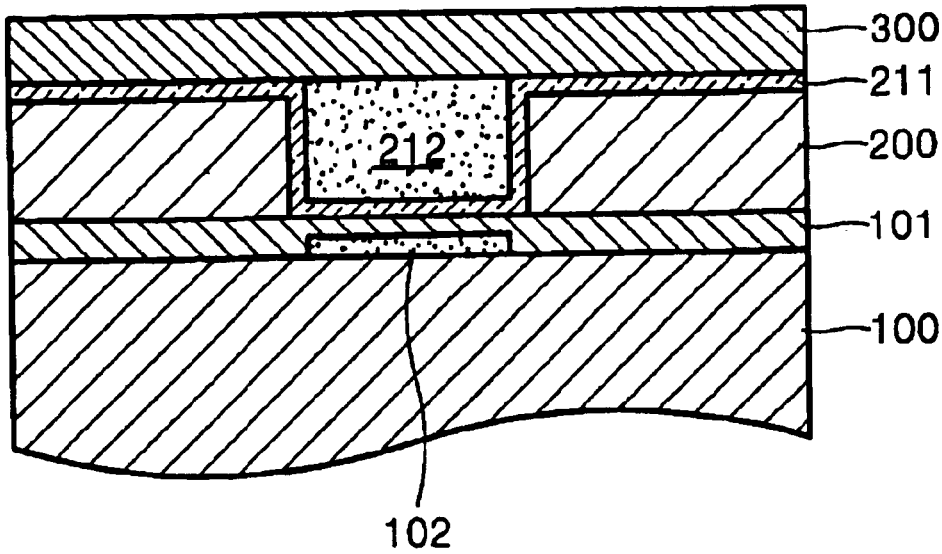

As shown in FIG. 6E, a photoresist, for example, polyimide, is spin-coated on the top surfaces of the adhering layer 211 and the mold layer 212 to form the nozzle plate 300, and then, the nozzle plate 300 is soft-baked.

Figure 6F:
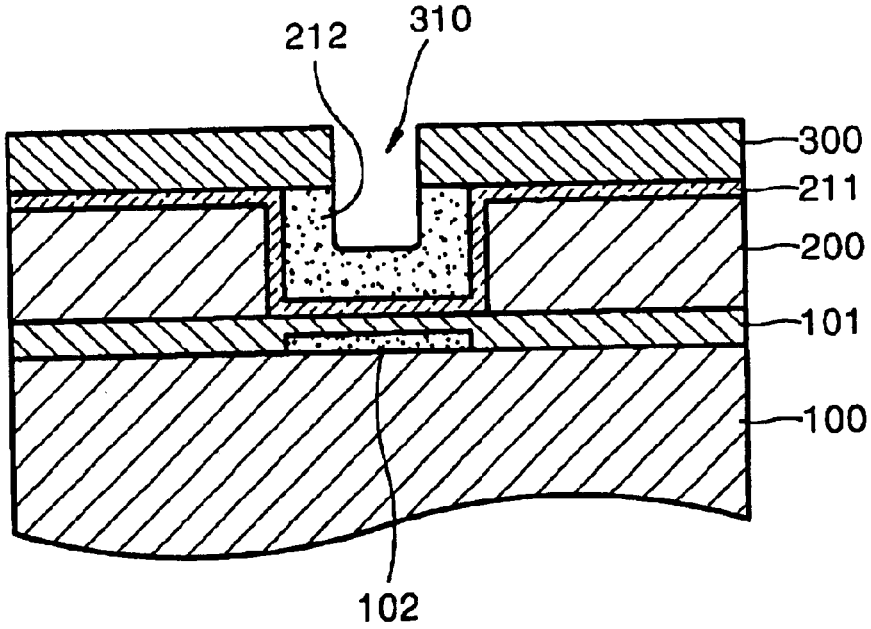

As shown in FIG. 6F, an orifice 310 corresponding to the ink chamber 210 is formed in the nozzle plate 300. The orifice 310 may be formed by forming a mask using a photoresist and by performing a patterning operation using wet and dry etch. Meanwhile, the photoresist may be exposed using a reticle having an exposure pattern.

Figure 6G:
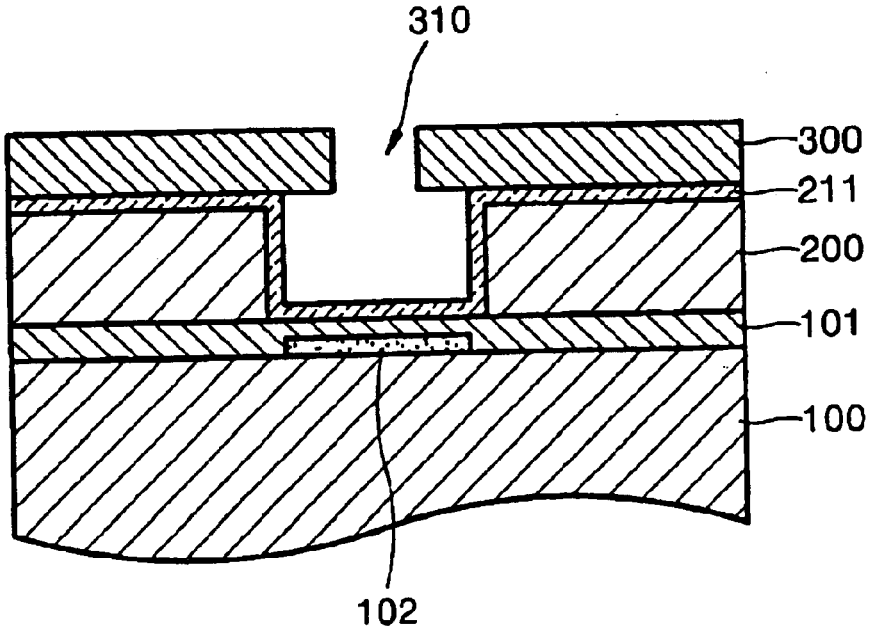

As shown in FIG. 6G, the mold layer 212 in the ink chamber 210 is removed. If ashing and stripping processes are performed when a mask used to form the orifice 310 is removed, the mold layer 211 in the ink chamber 210 can be removed also. A material remaining in the mold layer 211 and a photoresist remaining on other ink passages may be removed using a wet etchant after an ink feed hole is formed on the back side of the substrate 100.

Meanwhile, the second embodiment of the ink-jet printhead shown in FIG. 4 according to the present invention can be achieved by depositing an $SiO_2$ layer, an SiN layer, or an SiON layer through PECVD, after the operation shown in FIG. 6G. The third embodiment of the ink-jet printhead shown in FIG. 5 according to the present invention can be achieved by depositing an $SiO_2$ layer, an SiN layer, or an SiON layer by sputtering, after the operation shown in FIG. 6G.

As described above, according to the present invention, a passage plate and a nozzle plate are maintained as a separate body, and an adhering layer is formed between the passage plate and the nozzle plate such that the passage plate and the nozzle plate can be firmly adhered to each other. That is, after the nozzle plate is formed, even though the nozzle plate is not hard-baked, but only soft-baked, and an orifice is formed using an etchant and a mold layer is removed using an etchant, the adhering layer prevents an interface between the passage plate and the nozzle plate from becoming loose. In addition, since an additional coating layer is formed on the surface of the nozzle plate and may be formed on the bottom of an ink chamber, the inside of the ink chamber is protected from ink. In particular, since an etchant used at all of the boundaries of a substrate, for example, between the substrate and the passage plate and between the passage plate and the nozzle plate, is completely covered by the coating layer, the coating layer formed on the nozzle plate is protected from the etchant used when the mold layer is removed. In addition, a hydrophobic property is provided to the surface of the nozzle plate such that contamination of the nozzle plate and contamination of recording paper caused by the contamination of the nozzle plate can be prevented.

While this invention has been particularly shown and described with reference to preferred embodiments thereof, it will be understood by those skilled in the art that various changes in form and details may be made therein without departing from the spirit and scope thereof as defined by the appended claims.

Although a few preferred embodiments of the present invention have been shown and described, it would be appreciated by those skilled in the art that changes may be made in this embodiment without departing from the principles and spirit of the invention, the scope of which is define in the claims and their equivalents.

What is claimed is:

1. An ink-jet printhead comprising:

a substrate on which at least one heater and a passivation layer protecting the at least one heater are formed;

a passage plate which forms an ink chamber corresponding to the at least one heater; and a nozzle plate in which an orifice corresponding to the ink chamber is formed;

wherein the passage plate and the nozzle plate are formed of photoresist, and an adhesion layer formed of silicon-family low-temperature deposition material at a temperature limited by characteristics of the passage plate is disposed between the passage plate and the nozzle plate.

2. The ink-jet printhead of claim 1, wherein the passage plate and the nozzle plate are formed of polyimide.

3. The ink-jet printhead of claim 2, wherein the adhesion layer is formed of a material selected from a group of $SiO_2$, SiN, and SiON.

4. The ink-jet printhead of claim 3, wherein the adhesion layer is formed through plasma enhanced chemical vapor deposition (PECVD).

5. The ink-jet printhead of claim 1, further comprising a coating layer formed of silicon-family low-temperature deposition material on the surface of the nozzle plate.

6. The ink-jet printhead of claim 5, wherein the coating layer is formed of material selected from a group of $SiO_2$, SiN, and SiON.

7. The ink-jet printhead of claim 6, wherein the coating layer extends to a bottom of the ink chamber.

8. The ink-jet printhead of claim 5, wherein the coating layer extends to a bottom of the ink chamber.

9. The method of claim 8, wherein filling the ink chamber and the ink passage with the second photoresist comprises:

coating an entire surface of the second photoresist; and etching back to leave a photoresist only in the ink chamber.

10. The method of claim 8, further comprising, between the operations of forming an orifice and removing the second photoresist, ashing the second photoresist existing in the ink chamber by high temperature heating, and stripping a material remaining in the second photoresist using a wet etchant.

11. A method to manufacture an ink-jet printhead, the method comprising:

preparing a substrate on which a heater and a passivation layer protecting the heater are disposed;

forming a passage plate in which an ink chamber corresponding to the heater and an ink passage connected to the ink chamber are formed, of a first photoresist disposed on the substrate;

forming an adhering layer of a low-temperature silicon-family material on a surface of the passage plate;

filling the ink chamber and the ink passage with a second photoresist;

forming a nozzle plate of a third photoresist on the passage plate;

forming an orifice corresponding to the ink chamber in the nozzle place; and removing the second photoresist in the ink chamber.

12. The method of claim 11, wherein the first photoresist and the third photoresist are polyimide.

13. The method of claim 11, wherein the adhering layer is formed of a material selected from a group of $SiO_2$, SiN, and SiON.

14. The method of claim 13, further comprising depositing an $SiO_2$ layer, an SiN layer, or an SiON layer through plasma enhanced chemical vapor deposition (PECVD).

15. The method of claim 11, after the operation of removing the second photoresist, further comprising forming a coating layer of a low-temperature deposition silicon-family material on the nozzle plate.

16. The method of claim 15, wherein the coating layer is formed of a material selected from a group of $SiO_2$, SiN, and SiON.

17. The method of claim 15, wherein the coating layer is formed through plasma enhanced chemical vapor deposition (PECVD).

18. The method of claim 16 wherein the coating layer is formed through plasma enhanced chemical vapor deposition on (PEVCD).

19. The method of claim 11, wherein the second photoresist in the ink chamber is removed using a wet etch.

20. An ink-jet printhead comprising:

a substrate on which at least one heater and a passivation layer protecting the at least one heater are formed;

a passage plate which forms an ink chamber corresponding to the at least one heater;

an adhesion layer disposed on the passage plate and formed of silicon-family low-temperature deposition material at a temperature limited by characteristics of the passage plate; and a nozzle plate, disposed on the adhesion layer, in which an orifice corresponding to the ink chamber is formed.

21. The ink-jet printhead of claim 20, wherein the passage plate and the nozzle plate are formed of photoresist.

22. The ink-jet printhead of claim 20, wherein the passage plate and the nozzle plate are formed of polyimide.

23. The ink-jet printhead of claim 20, wherein the adhesion layer is formed of a material selected from a group of $SiO_2$, SiN, and SiON.

24. The ink-jet printhead of claim 20, wherein the adhesion layer is formed through plasma enhanced chemical vapor deposition (PECVD).

25. The ink-jet printhead of claim 20, further comprising a coating layer formed of a silicon-family low-temperature deposition material on the surface of the nozzle plate.

26. The ink-jet printhead of claim 25, wherein the coating layer is formed of material selected from a group of $SiO_2$, SiN, and SiON.

27. The ink-jet printhead of claim 25, wherein the coating layer extends to a bottom of the ink chamber.

28. The ink-jet printhead of claim 26, wherein the coating layer extends to a bottom of the ink chamber.

29. An ink-jet printhead comprising:

a multilayer structure that facilitates formation of a passivation plate-nozzle plate bond, wherein the multilayer structure includes:

a passage plate;

an adhesion layer disposed on the passage plate; and a nozzle plate disposed on the adhesion layer.

30. The ink-jet printhead of claim 29, further including a substrate on which at least one heater and a passivation layer protecting the at least one heater are formed and having the multilayer structure disposed on the passivation layer.

31. The ink-jet printhead of claim 30, wherein the multilayer structure comprises:

the passage plate, formed of polyimide that forms an ink chamber corresponding to the at least one heater;

the adhesion layer disposed on the passage plate and formed of silicon-family low-temperature deposition material at a temperature limited by characteristics of the passage plate; and the nozzle plate, formed of polyimide and disposed on the adhesion layer, in which an orifice corresponding to the ink chamber is formed.

32. The ink-jet printhead of claim 31, wherein the adhesion layer is formed of a material selected from a group of $SiO_2$, SiN, and SiON.

33. The ink-jet printhead of claim 31, wherein the adhesion layer is formed through plasma enhanced chemical vapor deposition (PECVD).

34. The ink-jet printhead of claim 31, wherein the multilayer structure further comprises a coating layer formed of silicon-family low-temperature deposition material on the surface of the nozzle plate.

35. The ink-jet printhead of claim 34, wherein the coating layer is formed of material selected from a group of $SiO_2$, SiN, and SiON.

36. The ink-jet printhead of claim 34, wherein the coating layer extends to a bottom of the ink chamber.

37. The ink-jet printhead of claim 36, wherein the coating layer extends to a bottom of the ink chamber.

* * * * *

UNITED STATES PATENT AND TRADEMARK OFFICE

CERTIFICATE OF CORRECTION

PATENT NO. : 6,846,068 B2
DATED : January 25, 2005
INVENTOR(S) : Yun-gi Kim

It is certified that error appears in the above-identified patent and that said Letters Patent is hereby corrected as shown below:

Column 8,
Line 18, after "16" insert -- , --;
Line 20, delete "on".

Signed and Sealed this

Sixth Day of December, 2005

JON W. DUDAS
*Director of the United States Patent and Trademark Office*